United States Patent [19]

Quach

[11] Patent Number: 4,779,494

[45] Date of Patent: Oct. 25, 1988

[54] SCREWDRIVER HAVING SCREW GRIPPING FEATURE

[75] Inventor: Jonathan Quach, Plano, Tex.

[73] Assignee: New Concepts, Washington, D.C.

[21] Appl. No.: 41,050

[22] Filed: Apr. 21, 1987

[51] Int. Cl.[4] ..... B25B 23/10

[52] U.S. Cl. ..... 81/443; 81/444

[58] Field of Search ..... 81/443, 446, 442, 444

[56] References Cited

U.S. PATENT DOCUMENTS

| | | | |
|---|---|---|---|
| 2,445,383 | 7/1948 | Barlow | 81/443 |
| 2,625,971 | 1/1953 | Bier | 81/443 |
| 3,003,528 | 10/1961 | Landau | 81/443 |
| 3,208,489 | 9/1965 | Walker et al. | 81/443 |
| 3,224,479 | 12/1965 | Osborn et al. | 81/443 |
| 3,288,184 | 11/1966 | Kyser | 81/443 |
| 3,354,919 | 11/1967 | Sugaya | 81/443 |
| 3,600,984 | 8/1971 | Bihlmaier | 81/443 |
| 3,900,057 | 8/1975 | Benitz | 81/443 |
| 4,078,593 | 3/1978 | Benitz | 81/443 |

*Primary Examiner*—James G. Smith

*Attorney, Agent, or Firm*—Holman & Stern

[57] ABSTRACT

A screw-gripping screwdriver includes a handle, a shaft composed of two blade members, a sleeve which is disposed coaxially about the blade members, and a tip. The blade members have inclined surfaces which cooperate with the sleeve so that, during movement of the sleeve along the blade members, a camming action occurs so that a relatively large movement of the sleeve causes a relatively small movement of the blade tips. In a preferred embodiment, each blade tip is an L-shaped portion, which in a first position of the sleeve adjacent to the handle, cooperates with the other one of the L-shaped portions to form a generally cruciform shape suitable for use with a Phillips head screw. In a second position, the sleeve has cammed the blade members toward one another so that the L-shaped portions are in frictional engagement with the interior walls of a cruciform opening in a Phillips head screw. In another embodiment, the blade tips are generally rectangular members suitable for use with a slot head screw. In a still further embodiment, the blade tip members have portions which are generally trapezoidal in shape suitable for use with a hexagonal opening in a hex head screw.

10 Claims, 2 Drawing Sheets

SCREWDRIVER HAVING SCREW GRIPPING FEATURE

BACKGROUND OF THE INVENTION

1. Technical Field

The present invention relates to a screwdriver having a screw gripping feature. The present invention relates more particularly to a screwdriver for gripping a Phillips-head screw. Other embodiments of the present invention relate to a screwdriver for gripping a plain slotted screw or hex head screw.

2. The Prior Art

In U.S. Pat. No. 2,445,383 to Barlow, a screwdriver is shown having a two-part expanding bit. The bit is for use with a standard slotted screw having a single slot therein. As seen in FIG. 12 of Barlow, the two-part expanding bit has a pair of inclined contacting surfaces which face one another, so that a force applied urging the two-part expanding bit portions together causes the two parts to be displaced sidewardly and against the walls of the slot formed in the screw. The inclined contacting face of the two parts of the bit can be considered as a first "camming" surface, which uses the inclined contact surfaces (22, 22 of Barlow) to create a translation of force from an axial direction along an axial line passing through the center of the slot of the screw, into a transverse force to that axial line, namely against the side walls of the slot in the screw. Depending on the angle of inclination of the contacting surfaces 22, 22 of Barlow, a mechanical advantage can be gained which would in effect multiply the force applied axially so that an even greater force would be applied transversely to the side walls of the slot formed in the screw.

Additionally, in the above-noted Barlow reference, a second "camming" means is used, namely the sleeve 23 acting against the parts 17 and 19 urging them toward one another. The parts 17 and 19 are two blade halves which are resiliently biased to a first position when the sleeve is against the handle, as seen in FIG. 1 of Barlow. As seen in FIG. 2 of Barlow, however, the sleeve 23, in moving away from the handle portion 25, exerts a force on the bit parts 17 and 19, which due to the relatively low angle of incline of the bit parts 17 and 19 results in a relatively large multiplication of the force applied. That is, the manual force exerted on the cylinder 23 during manual operation thereof is multiplied based upon the leverage principle of mechanical advantage so that a far greater force is achieved urging the two bits 21, 21 toward one another. As noted above, the force can be further multiplied due to the angle at which the contacting surfaces 22, 22 are relatively disposed. The Barlow reference does not suggest use of a two-part expanding bit for use with a Phillips-head screw, and also the Barlow reference requires the use of two different "cammingp" means.

In U.S. Pat. No. 3,224,479 to Osborn et al, an expanding bit screwdriver is shown having a movable sleeve and a two-part bit. A pair of bit interceptors 13 are shown in FIGS. 4 and 5 of Osborn et al., which are engaged by the sleeve during axial movement thereof, to force sliding movement of the expandable parts 12*a* and 12*b* relative to one another along a sliding contact surface referred to as a slip plane 12*c*. The interceptors 13 are a camming surface acted upon by the sleeve, and the slip plane 12*c* is a second camming surface which causes lateral relative movement of the expandable parts 12*a* and 12*b* in a direction which is perpendicular to the slot of a slot head screw, thereby giving rise to frictional contact forces to retain the screw to the expanding bit.

U.S. Pat. No. 2,625,971 to Bier shows a screw-holding attaching device for cruciform bit screwdrivers. Here, the screwdriver is made to retain a Phillips screw thereon by use of a camming or wedging action by spreading of tips 26 until outer faces of the tips are forced tightly against the sidewalls of the kerf of the screw and coact therewith.

In U.S. Pat. No. 3,208,489 to Walker, et al., a Phillips-head screw starter is shown having a relatively complex bit shape in the form of a pair of opposed V-shaped portions 26,26 as shown in FIG. 5 thereof. The portions are resiliently biased apart, and a sleeve initially maintains them in their abutting configuration, such that retraction of the sleeve permits expansion thereof so as to frictionally retain a Phillips head screw. Here, camming is used only to initially form the generally X-shaped head by positioning the two V-shaped portions, and removal of the camming action permits spreading of the V-shaped portions.

In U.S. Pat. No. 3,288,184 to Kyser, another Phillips head screw starter is shown having a pair of V-shaped bits which move apart from one another by retraction of a camming member. The V-shaped portions are resiliently biased apart, such that the camming member holds them together for insertion into a Phillips head screw. Here, the spreading of the V-shaped portions occurs in a direction which generally bisects each V-shaped portion.

In U.S. Pat. No. 3,354,919 to Sugaya, another type of screwdriver is shown, having an embodiment usable in a hex head screw socket. A locking device is used in these embodiments, which rotates internally of the screwdriver shaft to cause gripping of the screw by the screwdriver blade.

In U.S. Pat. No. 3,003,528 to Landeau, a screw holding screwdriver is shown having a pivot 19 and a sleeve 24 which cooperates with a camming surface, such that the screwdriver blade tip pivots about the pivot point to cause relative displacement of two halves of a screwdriver blade tip, to frictionally lock or grip a slot head screw.

It is a problem in the prior art to provide a screwdriver blade tip which is capable of frictionally retaining a screw thereon, particularly for Phillips head screws. It is also a problem in the prior art to provide a relatively simple mechanism for frictionally retaining screws on the tip of a screwdriver using a single camming surface to cause relative movement of two portions of a screwdriver bit.

SUMMARY OF THE INVENTION

According to the present invention, in a preferred embodiment, a pair of relatively movable L-shaped members and respective supporting blades together form a screwdriver bit, the L-shaped members being tip portions of respective blades and being each movable along the direction of a predetermined one of the legs of each respective L-shaped portion. The blades together form a shank of the screwdriver. The movement is accomplished by movement of a sleeve along the shank of the screwdriver, the sleeve acting upon a camming surface of each respective blade. The pair of blade members are, in the absence of the sleeve, resiliently biased outwardly, and in use are retained in place by the sleeve.

When the sleeve is in a first position relative to the screwdriver handle, two L-shaped blade tips assume an X-shaped configuration having an offset pair of arms and are in abutting contact with each other. When the sleeve is moved to a second position, away from the handle, it engages camming surfaces of the two blade members to urge the two blade members toward one another.

As the blade members move relative to each other along the direction of a predetermined one of the legs of the L-shaped tip, the L-shaped blade tips slide relative to each other to move to a position wherein they frictionally grip the Phillips head screw and to cause a tendency toward rotation of the Phillips head screw during movement of the sleeve from the initial position adjacent the handle to the second position away from the handle. The tendency toward rotational movement of the screw during this movement is due to the taking up of the clearance which may exist between the blade tips and the Phillips head slot.

The urging of the L-shaped blade tips relative to one another causes frictional forces to arise between the internal walls of the Phillips head slot and the L-shaped blade tip portions. These frictional forces retain the Phillips head screw on the screwdriver, according to the present invention.

In a modified form of the invention, the blade tips can be straight, for use with a slot head screw. In still another embodiment, the blade tips can have a generally trapezoidal cross section adapted for use with a hex head screw.

Additional embodiments for use with other types of headed members based upon the present invention will be evident to one having skill in the art to which the present invention pertains. All such additional embodiments are contemplated as being within the scope of the present invention.

DETAILED DESCRIPTION OF THE INVENTION

Figure 1:
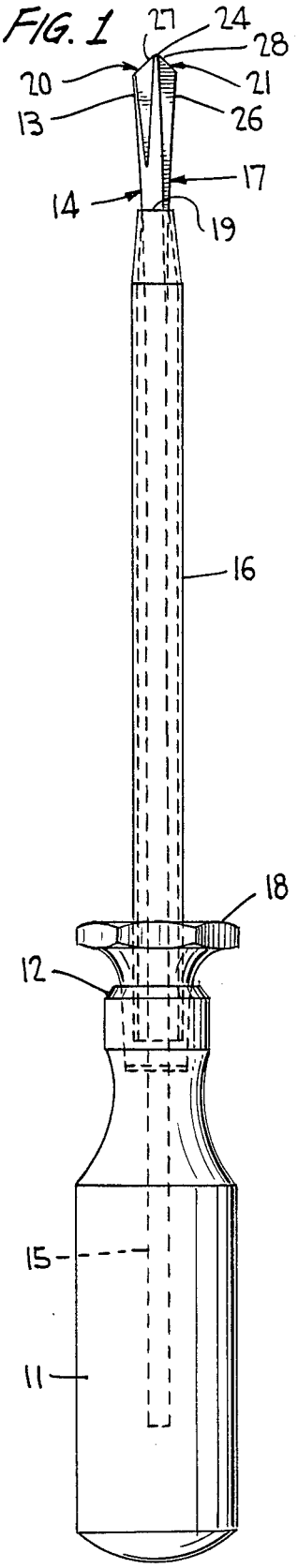
FIG. 1 is a side elevational view of a screwdriver according to the present invention, having a sleeve in an initial position.

FIG. 1 shows a side elevational view of a screwdriver according to the present invention. A handle 11 having an end 12 supports a shank 15, the shank 15 being composed of adjacent blade members 14 and 17. Blade member 14 and shank 15 are shown in dotted outline in FIG. 1.

A sleeve 16 having a distal edge 19 is slideably mounted on the blade members 14 17. The sleeve 16 has an annular portion 18 adapted for manual engagement with the fingers of a user, the annular portion 18 being fixedly connected to the sleeve 16 by any known means.

Figure 2:
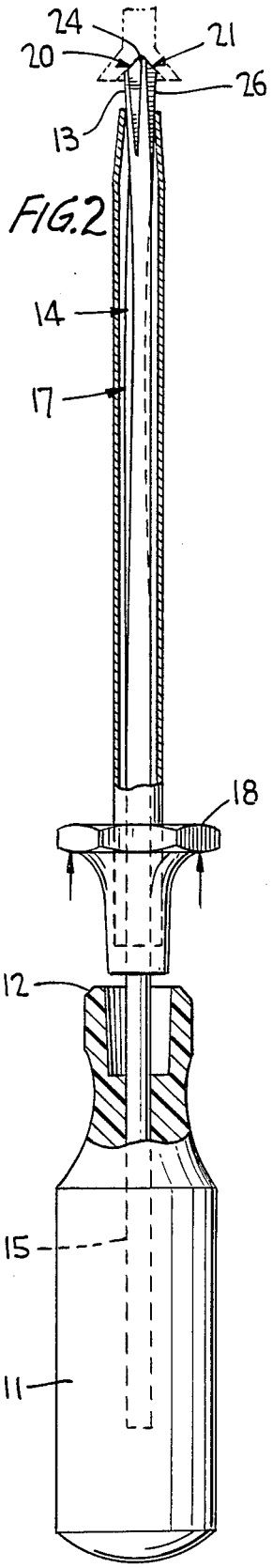
FIG. 2 is a side elevational view, partially in section, showing the sleeve in a second, final position for causing blade tips to retain a screw.

In FIG. 1, the sleeve 16 is in a first, initial position with the annular portion 18 abutting the end 12 of the screwdriver handle 11. In FIG. 2, the sleeve 16 is shown in a second, final position with the annular portion 18 having been moved by manual urging away from the end 12 of the handle 11. In FIG. 2, the screwdriver is seen supporting in frictional engagement a screw (unnumbered), the screw being shown in phantom outline in FIG. 2.

As seen in FIGS. 1 and 2, the blade members 14 and 17 have respective inclined surfaces 13,26 which are camming surfaces acted upon by the sleeve 16. The inclined surfaces 13,26 act as force multipliers according to the well-known incline principle, so that a relatively large movement of the cylinder 16 results in a relatively small movement of the blade members 14,17, so that the relatively small manual force exerted on the cylinder 16 is correspondingly multiplied to cause a much greater force to exist urging the blade members 14,17 toward one another.

Figure 3:
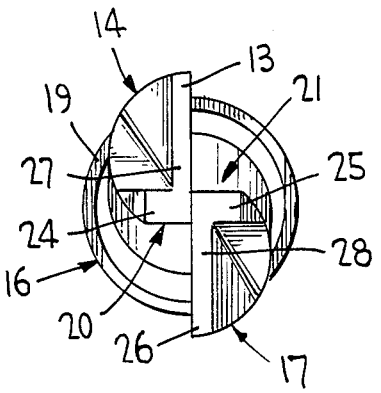
FIG. 3 is a top elevational view of the blade tips and the surrounding sleeve when the sleeve is in the initial position.

Also as seen in FIGS. 1 and 2, the tip of the blade member 14 in the preferred embodiment has an additional extending blade tip portion 24 which, together with the blade tip portion 27, forms an L-shaped tip 20. In the preferred embodiment, as seen in FIGS. 1–3, the blade member 17 has blade tip portions 25 and 28, which form an L-shaped tip 21. As seen in FIG. 3, the two L-shaped tips 20,21 of the blade members 14 and 17 are, in the first, initial position of the sleeve 16, disposed in a generally cruciform overall pattern adjacent one another for insertion into a cruciform opening in a Phillips head screw.

Figure 4:
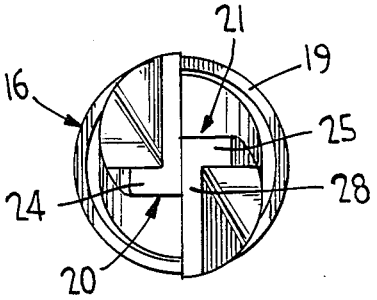
FIG. 4 is a top elevational view similar to FIG. 3, with the sleeve in the second, final position.

As seen in FIG. 3, the sleeve 16 extends about the blade members 14,17 and is in engagement with the inclined portions 13,26. In the second, final position of the sleeve 16, corresponding to FIG. 4, the sleeve 16 has caused displacement of the blade members 14,17 relative to one another. The blade members 14,17 are in sliding contact throughout movement between the first, initial position of the sleeve 16 and the second, final position of the sleeve 16. The sleeve 16 serves to retain the blade members 14,17 together, the blade members 14,17 being disposed in the handle 11 such that they ordinarily would be in abutting contact with one another, as shown in FIGS. 3 and 4.

Figure 5:
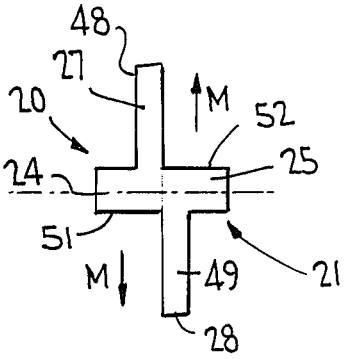
FIG. 5 is a schematic view showing the relative movement of the L-shaped blade tips as they are initially urged from their initial position.

FIG. 5 illustrates schematically the L-shaped tips 20,21 of the blade members 14,17 as they exist in the first, initial position of the sleeve 16 instantaneously with the first, initial movement of the sleeve 16 toward the second, final position. As seen in FIG. 5, arrows M,M indicate the direction in which movement will take place. The L-shaped configuration of the blade tips 20,21, respectively, is clearly evident in FIG. 5. A dotted centerline in FIG. 5 illustrates a main axis of the blade tip configuration in the first, initial position. The shape of the abutting L-shaped blade tips 20,21 do not, together, form a perfectly cruciform configuration, but rather form a somewhat more complex configuration comparable to that of a cross having one of the lengthwise members thereof having two oppositely extending portions which are offset from one another by their width. This configuration thus requires that the L-shaped blade tips 20,21 be sufficiently thin to permit insertion of the blade tip configuration of FIG. 5 into a cruciform opening in a Phillips head screw, even though the blade tip portions 27 and 28 are relatively offset from one another, by the thickness of their width, away from a perfectly cruciform shape.

As seen in FIG. 5, the blade tip 20 has a forward surface 51 and a lateral surface 48. The blade tip 21 has a forward surface 52 and a lateral surface 49.

The present invention therefore teaches that the L-shaped blade tips 20,21 be sufficiently thin so as to ensure that some play or clearance exists between the tips 20,21 and the internal side walls of the cruciform opening in a Phillips head screw. Movement of the blade members 14,17 in the directions indicated in FIG. 5 would have a tendency to rotate the Phillips head sorew in a counterclockwise direction, except for the forces arising against the lateral walls 48,49, which thereby prevent rotation. This tendency to rotate causes a more equal distribution of force on the lateral surfaces 48 and 49 of the blade tips 20 and 21, respectively. Otherwise, the primary forces would occur only on the forward surfaces 51,52. Thus, according to the present invention, a portion of the total contact forces arising against the internal side walls of the cruciform opening in the Phillips head screw is sustained by the lateral walls 48,49, respectively.

Figure 6:
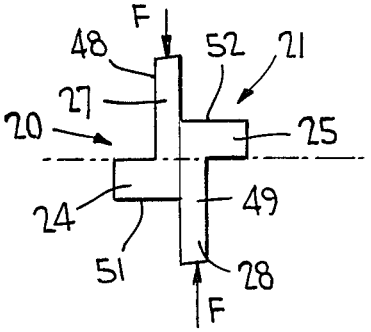
FIG. 6 is a schematic view showing the resulting position of the blade tips when the sleeve is in its second, final position, showing the camming forces which act on the blade tips in this position.

FIG. 6 illustrates schematically the displacement which has occurred in the blade members 14,17 from the original centerline indicated as a dashed line in FIG. 6. The displacement from the centerline position is exaggerated for clarity. A pair of arrows F,F show the retaining forces transmitted by the sleeve in the second, final position, via the inclined surfaces 13,17, respectively, against the blade tip portions 27 and 28, respectively. As seen in FIG. 6, the final configuration of the blade tips 20,21, taken as a whole, is considerably more complex than a simple cruciform configuration, and differs significantly from that shown in the initial position illustrated in FIG. 5.

Figure 7:
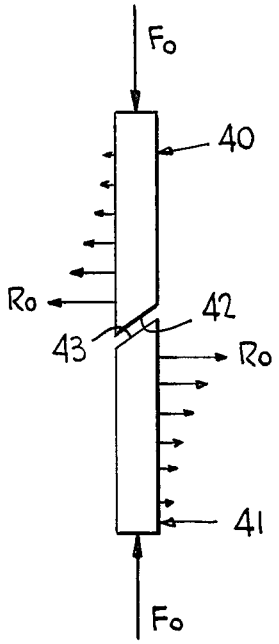
FIG. 7 (PRIOR ART)
FIG. 7 shows schematically a prior art embodiment, illustrating the physical principles involved and showing the side frictional resultant forces typically acting on the internal walls of a slot head screw.

FIG. 7 illustrates the basic structure and operating principles of a blade tip of screw-gripping screwdriver blades according to the prior art. In the prior art, forces $F_o$,$F_o$ are applied along a longitudinal axis of a pair of blade tips 40,41. This longitudinal force is translated into a transverse force indicated by vectors $R_o$,$R_o$ due to the slip plane created by slanted surfaces 42,43. As seen in FIG. 7, due to the location of the slip plane at surfaces 42,43, the transversely-directed forces $R_o$,$R_o$ are greatest at a location nearest the respective slanted surface 42 and 43, and diminish progressively in the longitudinal direction moving along the blade away from the respective slanted surfaces 42 and 43.

Figure 8:
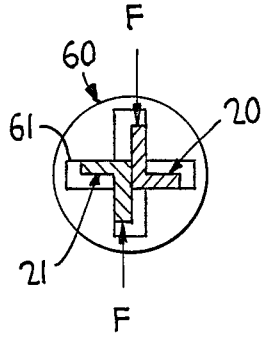
FIG. 8 is a top elevational view of a Phillips head screw showing in section the blade tips according to the present invention in their second, final configuration for gripping.

FIG. 8 shows an elevational view of a screw 60 having a cruciform opening 61 therein. In FIG. 8, the blade tips 20,21 according to the present invention are seen in sectional outline, and appear reversed from that shown in the schematic views 5 and 6 since seen from the opposite direction as they would be inserted in the opening 61. The pair of arrows F,F indicate the direction of force applied by the sleeve 16 which is transmitted through the blade members 14,17, respectively, to respective ones of the blade tips 20,21 shown in sectional view in FIG. 8. The clearance between sidewalls of the opening 61 and the blade tips 20,21, are readily apparent in FIG. 8.

Figure 9:
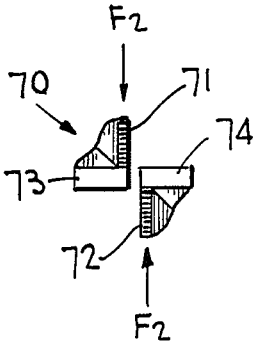
FIG. 9 is an end elevational view of screwdriver blades according to an alternative embodiment for use with slotted screws.

FIG. 9 is an end elevational view of an alternative embodiment of the present invention. In this figure, a blade 70 has a pair of blade tips 73,74 which have raised, inclined portions 71,72, which correspond generally to the portions 13,26 of the embodiment of FIGS. 1–6, which are shown as being acted upon by respective forces $F_2$,$F_2$. In this instance, instead of L-shaped blade tip portions shown by FIGS. 3–6 and 8, the blade tip portions 73,74 are generally rectangular.

Figure 10:
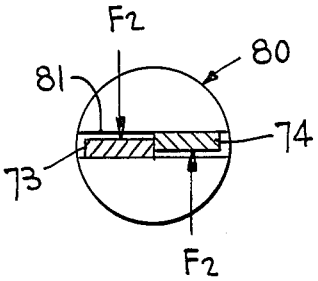
FIG. 10 is a top elevational view of an alternative embodiment of the present invention for use with slot head screws.

FIG. 10 illustrates the blade 70 of FIG. 9 as it would be used in a slotted screw 80. Slotted screw 80 has a generally rectangular opening 81 therein which receives the blade tips 73,74. The pair of arrows $F_2$,$F_2$ are illustrated to show the forces transmitted to the respective blade tips 73,74 transversely to a longitudinal axis of the slot 81. Thus, in this alternative embodiment, frictional forces arise between the tip portions 73,74 and the screw opening 81 due to the respective forces $F_2$,$F_2$ created by movement of the sleeve 16. FIGS. 9 and 10 correspond to an alternative embodiment where only the tip shape has been changed, with the remaining portions of the mechanism of the screwdriver shown in FIGS. 1–6 as discussed hereinabove remaining the same.

Figure 11:
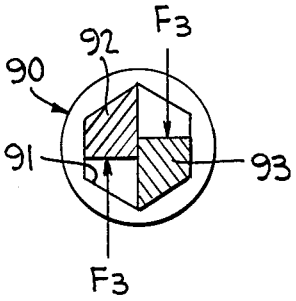
FIG. 11 is an alternative embodiment for use with a hex head screw.

FIG. 11 is an alternative embodiment similar to that shown in FIGS. 8 and 10, with a hex head screw 90 being shown having a hexagonal opening 91 therein. Here, a pair of generally trapezoidal blade tips 92,93 are urged into frictional engagement with the walls of the opening 91 by respective forces $F_3$,$F_3$. This tip configuration could be used instead of the tip configuration shown in the embodiment of FIGS. 9 and 10. Other suitable tip shapes, for other types of headed members having openings therein, are all contemplated as being within the scope of the present invention.

While a preferred embodiment has been shown and described, and alternative embodiments have been also shown, it will be understood that the present invention is not limited thereto, but may be otherwise embodied within the scope of the following claims.

What is claimed is:

1. A screwdriver, for selectively gripping screws having openings therein, the openings having sidewalls, comprising:

a handle means;

a blade means connected to said handle means;

said blade means having a pair of blade members;

each of said blade members having a tip means and having a genrally flat non-camming contact surface;

each respective contact surface of said blade members being in contact with the other one of said contact surfaces;

each of said tip means being movable in a predetermined direction relative to the other one of said tip means;

a single camming means for urging each of said tip means relative to another in each said respective predetermined direction, which is generally parallel to said generally flat contact surfaces;

whereby said tip means are urged into frictional engagement with the sidewall of the opening in the screw solely by said single camming means.

2. A screwdriver as claimed in claim 1, wherein said blade members are elongated members which are adapted to be biased into engagement with one another.

3. A screwdriver as claimed in claim 1, wherein said camming means includes an axially-movable sleeve surrounding said blade members.

4. A screwdriver as claimed in claim 3, wherein each of said blade members has an inclined surface increasing in radial height with axial distance from said handle;

said axially-movable sleeve being movable along said blade members away from said handle and into engagement with said inclined surfaces.

5. A screwdriver as claimed in claim 1, wherein each said tip means includes an L-shaped portion.

6. A screwdriver as claimed in claim 5, wherein said camming means has a first position and a second position;

in said first position, each of said L-shaped portions being adjacent one another so as to form a generally cruciform configuration.

7. A screwdriver as claimed in claim 6, wherein in said second position, said camming means has caused movement of said L-shaped portions relative to one another due to engagement with inclined surfaces disposed on each of said blade members.

8. A screwdriver as claimed in claim 1, wherein each said tip means includes a generally rectangular portion in cross-section adapted for insertion into a slotted head screw.

9. A screwdriver as claimed in claim 1, wherein each of said tip means includes a generally trapezoidal portion in cross-section adapted for insertion into a hex head screw.

10. A screwdriver as claimed in claim 3, wherein each of said blade members includes an inclined surface extending outwardly from an axis of said sleeve for engagement with said sleeve during movement of said sleeve from a first position adjacent said handle to a second position away from said handle along said blade members;

each of said tip means being generally L-shaped;

a first leg of each said L-shaped tip means extending generally in a same direction as said inclined surface of said blade member, while a second leg of said L-shaped tip means extends generally perpendicularly to said first leg.

* * * * *